US006263800B1

(12) United States Patent
Wilson

(10) Patent No.: US 6,263,800 B1
(45) Date of Patent: Jul. 24, 2001

(54) RAIL SUPPORT SYSTEM

(76) Inventor: Timothy R. Wilson, 1805-2nd Ave. North, Moorhead, MN (US) 56560

( * ) Notice: Subject to any disclaimer, the term of this patent is extended or adjusted under 35 U.S.C. 154(b) by 0 days.

(21) Appl. No.: 09/389,261

(22) Filed: Sep. 3, 1999

(51) Int. Cl.[7] ..... B05B 7/26; B05B 15/06
(52) U.S. Cl. ..... 104/315; 104/281
(58) Field of Search ..... 104/2; 238/310, 238/311, 315, 338, 264, 281

(56) References Cited

U.S. PATENT DOCUMENTS 4,632,308 * 12/1986 Fischer ..... 238/265
5,150,835 * 9/1992 Yamamoto ..... 238/50
5,862,759 * 1/1999 Mauli et al. ..... 104/12

* cited by examiner

*Primary Examiner*—S. Joseph Morano
*Assistant Examiner*—Robert J. McCarry, Jr.
(74) *Attorney, Agent, or Firm*—Michael S. Neustel

(57) ABSTRACT

A rail support system for adjustably supporting a pair of abutting rails to be welded together. The inventive device includes a pair of support devices each comprising a support base, a first lift assembly attached to an end of the support base, a second lift assembly attached to an opposing end of the support base, a pair of locking handles attached to the support base for engaging a lower portion of the rail, and a gripping handle attached to the support base for allowing manual manipulation of the present invention by a user. The lift assemblies are comprised of a screw type jack system or a hydraulic jack system. By differentiating the lift assemblies the user is able to manually twist the rail in the desired direction to create an alignment with the opposing rail. The pair of locking handles are preferably positioned upon a slide plate that is adjustably positioned upon the support base thereby allowing the user to adjust the horizontal position of the rail also. The present invention allows repositioning of the horizontal, vertical and rotational position of a rail which is desirable when welding two abutting rails.

19 Claims, 5 Drawing Sheets

RAIL SUPPORT SYSTEM

BACKGROUND OF THE INVENTION

1. Field of the Invention

The present invention relates generally to rail support devices and more specifically it relates to a rail support system for adjustably supporting a pair of abutting rails to be welded together.

Railroad companies generally weld abutting ends of rails together for providing increased support when secured to wooden ties. It is desirable to weld the rails at an angle with respect to the ground surface typically 3.5 degrees for each rail thereby creating an inverted V-shaped. After the rails are welded together, they are allowed to cool. After the desired period of time for cooling, approximately 15 minutes, the rails are lowered and the excess weld material is sheared off with conventional shearing tools thereby creating a smooth rail. Do to unevenness in the rails and terrain, it can be difficult to align the adjacent ends of the rails resulting in a weakened weld. Hence, there is a need for a rail support system that adjustably supports the abutting ends of two rails being welded.

2. Description of the Prior Art

Rail support devices have been in use for years. One type of conventional rail support device is the use of two wedges that have a slanted edge that is positioned underneath each of the rails to elevate the ends.

There are three disadvantages to utilizes wedges to elevate the ends of the rails during the welding process. First, the wedges are driven underneath the rails with a hammer or other device which causes tremendous side forces sometimes resulting in twisting of the rails. Second, it is extremely time consuming and labor intensive to properly elevate two opposing rails which are extremely heavy. Third, a conventional shear device is unable to immediately shear the excess weld because the wedges are in the way.

A second device that can be utilized to elevate the opposing rails is commonly referred to as an "A-frame" which utilizes conventional elevating means directly above the rails to elevate them. However, as stated with the wedges, the physical structure of the A-frames is inconvenient to utilize compared to the present invention.

While these devices may be suitable for the particular purpose to which they address, they are not as suitable for adjustably supporting a pair of abutting rails to be welded together. Conventional rail support devices are cumbersome to utilize and often result in uneven alignment of the rails. In addition, conventional rail support devices do not allow the welded area to be sheared and grinded immediately thereby delaying the welding process significantly eventually resulting in increased costs for the company.

In these respects, the rail support system according to the present invention substantially departs from the conventional concepts and designs of the prior art, and in so doing provides an apparatus primarily developed for the purpose of adjustably supporting a pair of abutting rails to be welded together.

SUMMARY OF THE INVENTION

In view of the foregoing disadvantages inherent in the known types of rail support devices now present in the prior art, the present invention provides a new rail support system construction wherein the same can be utilized for adjustably supporting a pair of abutting rails to be welded together.

The general purpose of the present invention, which will be described subsequently in greater detail, is to provide a new rail support system that has many of the advantages of the rail support devices mentioned heretofore and many novel features that result in a new rail support system which is not anticipated, rendered obvious, suggested, or even implied by any of the prior art rail support devices, either alone or in any combination thereof.

To attain this, the present invention generally comprises a pair of support devices each comprising a support base, a first lift assembly attached to an end of the support base, a second lift assembly attached to an opposing end of the support base, a pair of locking handles attached to the support base for engaging a lower portion of the rail, and a gripping handle attached to the support base for allowing manual manipulation of the present invention by a user. The lift assemblies are comprised of a screw type jack system or a hydraulic jack system. By differentiating the lift assemblies the user is able to manually twist the rail in the desired direction to create an alignment with the opposing rail. The pair of locking handles are preferably positioned upon a slide plate that is adjustably positioned upon the support base thereby allowing the user to adjust the horizontal position of the rail also. The present invention allows repositioning of the horizontal, vertical and rotational position of a rail which is desirable when welding two abutting rails.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a rail support system that will overcome the shortcomings of the prior art devices.

Another object is to provide a rail support system that adjustably supports two opposing rails in a desired position during welding.

An additional object is to provide a rail support system that allows the welded area to be immediately sheared and grinded without removing the support devices.

A further object is to provide a rail support system that eliminates unintentional twisting of the rails during elevating.

Another object is to provide a rail support system that significantly reduces the amount of time required to weld two opposing rails together.

An additional object is to provide a rail support system allows each individual rail to be twisted in the desired direction if required.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
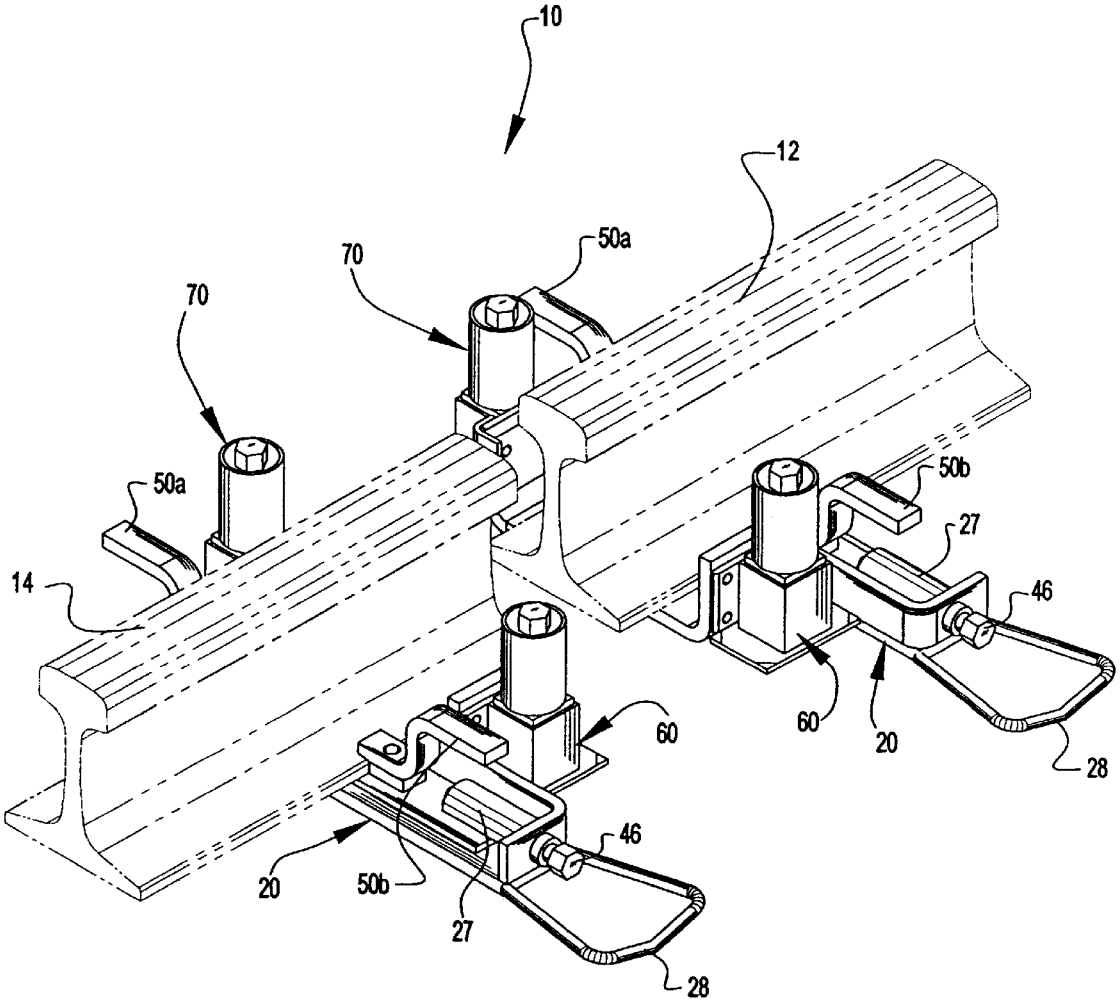
FIG. 1 is an upper perspective view of the present invention supporting two abutting rails FIG. 2 Skis an exploded upper perspective view of the present invention.

Turning now descriptively to the drawings, in which similar reference characters denote similar elements throughout the several view, FIGS. 1 through 5 illustrate a rail support system 10, which comprises a pair of support devices each comprising a support base 20, a first lift assembly 60 attached to an end of the support base 20, a second lift assembly 70 attached to an opposing end of the support base 20, a pair of locking handles 50*a–b* attached to the support base 20 for engaging a lower portion of the rail, and a gripping handle 28 attached to the support base 20 for allowing manual manipulation of the present invention by a user. The lift assemblies are comprised of a screw type jack system or a hydraulic jack system. By differentiating the lift assemblies the user is able to manually twist the rail in the desired direction to create an alignment with the opposing rail. The pair of locking handles 50*a–b* are preferably positioned upon a slide plate 30 that is adjustably positioned upon the support base 20 thereby allowing the user to adjust the horizontal position of the rail also. The present invention allows repositioning of the horizontal, vertical and rotational position of a rail which is desirable when welding two abutting rails.

Figure 2:
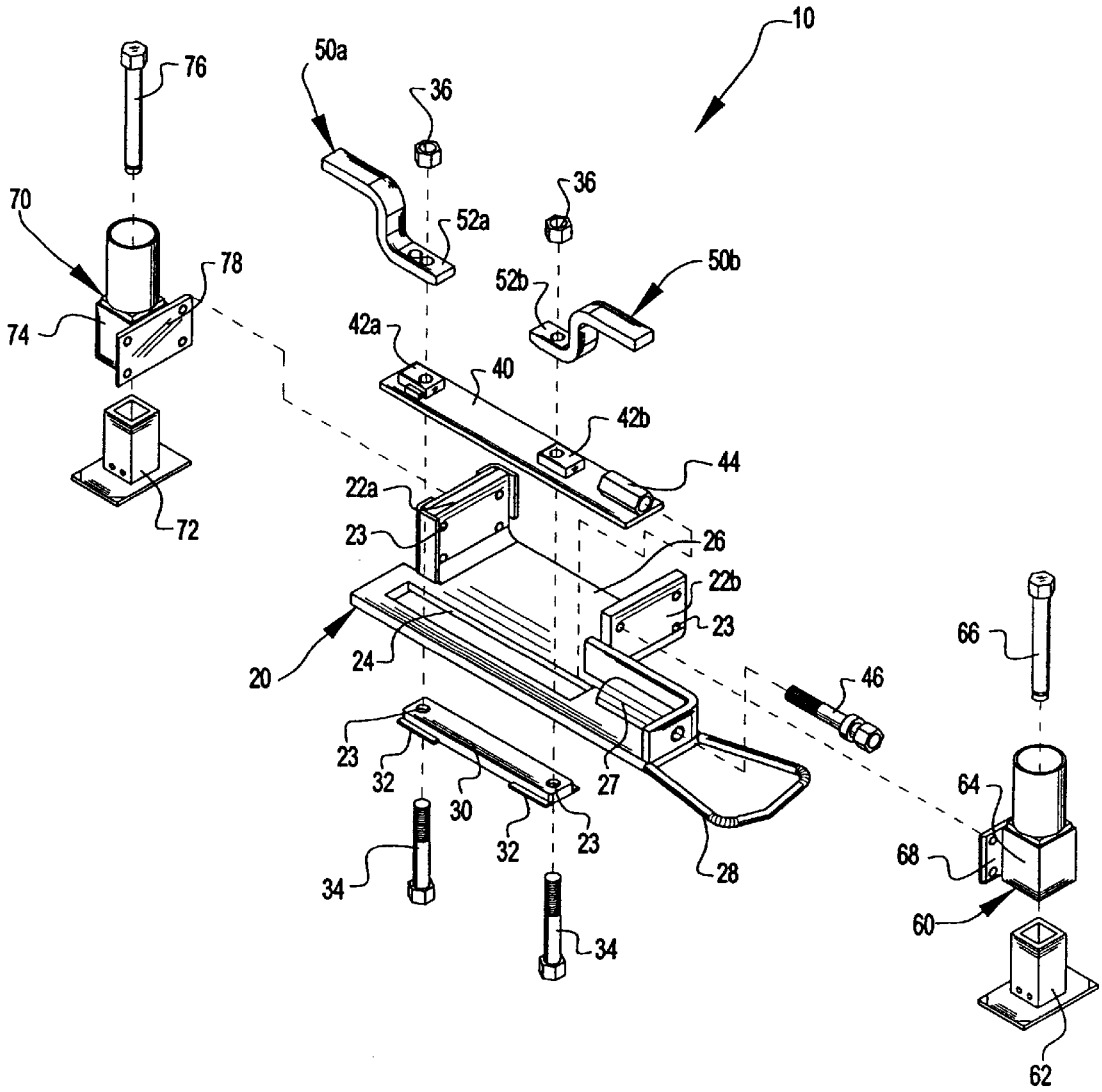

As best shown in FIG. 2 of the drawings, the support base 20 is attachable to the first lift assembly 60 and the second lift assembly 70. The support base 20 has a U-shaped structure with a swaged portion 26. A handle 28 is attached to an end of the support base 20 for allowing manual manipulation of the invention.

Figure 3:
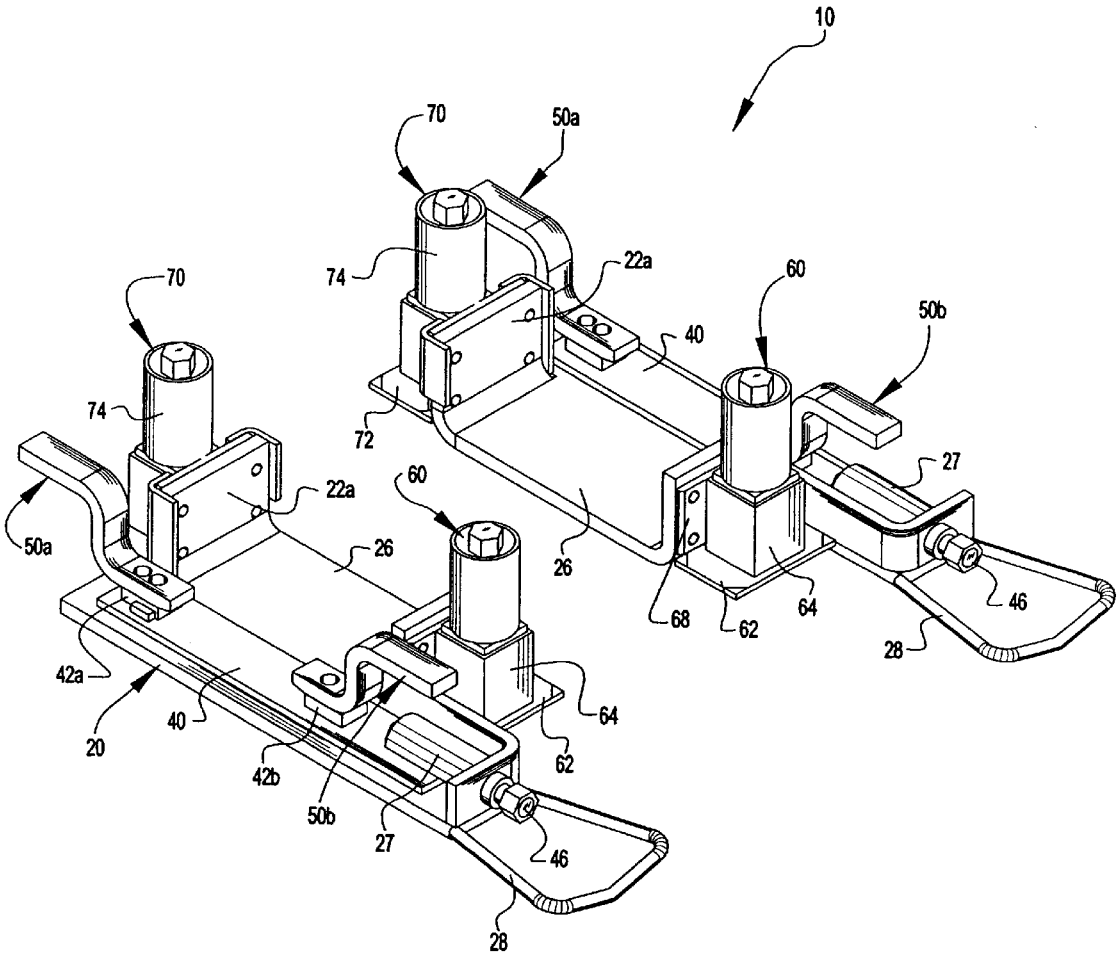
FIG. 3 is an upper perspective view of the present invention.

A pair of brackets 22*a–b* are attached to the opposing ends of the support base 20 as best shown in FIGS. 2 and 3 of the drawings. The brackets 22*a–b* are attachable to the first lift assembly 60 and the second lift assembly 70 as shown in FIG. 3 of the drawings. A plurality of apertures 23 within the brackets 22*a–b* allow conventional securing devices to secure the first lift assembly 60 and the second lift assembly 70 to the brackets 22*a–b*.

As best shown in FIG. 2 of the drawings, a slot 24 extends traversely into the lower portion of the support base 20. The lower perimeter of the slot 24 is recessed slightly for receiving the flanged portions 32 of the slide plate 30.

As best shown in FIG. 2 of the drawings, the slide plate 30 is an elongated structure that is shorter in length than the slot 24 for allowing movement of the slide plate 30 within the slot 24. The width of the slide plate 30 is slightly smaller than the interior width of the slot 24 for allowing easy sliding of the slide plate 30 within.

As further shown in FIG. 2 of the drawings, the slide plate 30 includes a plurality of apertures 23. As shown in FIG. 2, a corresponding number of fasteners 34 extend through the apertures 23 within the slide plate 30. A pair of flanged portions 32 extend from the distal ends of the slide plate 30 for guiding the slide plate 30 within the slot 24 during use.

As shown in FIGS. 2 and 3 of the drawings, an upper plate 40 is provided having an elongated structure. A pair of spacer members 42 are secured to an upper surface of the upper plate 40. A pair of handles 50*a–b* are provided that are positionable upon the spacer members 42. An aperture extends through the pair of handles 50*a–b*, the spacer members 42 and the upper plate 40 as shown in FIG. 2 of the drawings. The fasteners 34 extending through the slide plate 30, the upper plate 40, the spacer members 42 and the handles 50*a–b* thereby allowing a corresponding number of nuts 36 to be threadably attached thereto.

Figure 5:
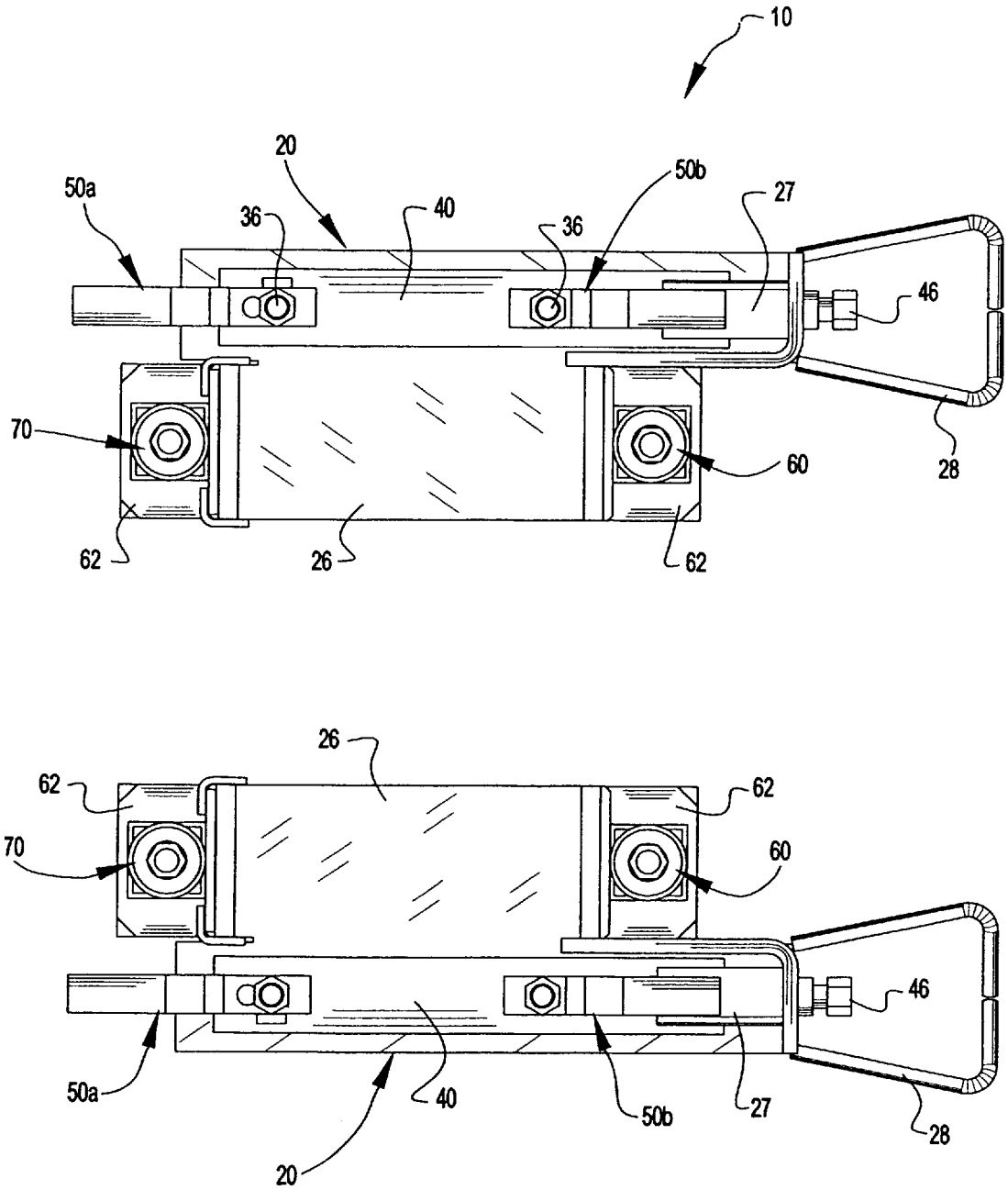
FIG. 5 is a top view of the present invention.

The handles 50*a–b* are threadably attached about the fasteners 34 as shown in FIGS. 2, 3 and 5 of the drawings. The handles 50*a–b* include a lip portion 52*a–b* that is enageable over the lower flanged edge of a rail 12, 14 thereby maintaining the rail 12, 14 in a fixed position.

As best shown in FIG. 2 of the drawings, an interiorly threaded tube 44 is secured to an end of the upper plate 40. An adjustment shaft 46 extends through an aperture within a side portion of the support base 20 and is threadably engageable with the threaded tube 44 for allowing adjustment of the position of the upper plate 40 and the slide plate 30. The adjustment shaft 46 is rotatably positioned within the support base 20 and includes a cincture for preventing the adjustment shaft 46 from moving longitudinally within the support base 20. A shield 27 is secured to the support base 20 about the adjustment shaft 46 as shown in FIGS. 2 and 3 of the drawings.

As shown in FIGS. 1, 2, 3 and 5 of the drawings, a first lift assembly 60 is attachable to the bracket 22*b* of the support base 20. The first lift assembly 60 includes a first base 62 having a flat plate for engaging a ground surface. The first lift assembly 60 further includes a first body 64 that is slidably positionable over the first base 62. A first attachment plate 68 is secured to the side of the first body 64 for allowing attachment to the bracket 22*b*. A first adjustment member 66 is rotatably attached within the interior of the first body 64 and is threadably engaged with the interior of the first base 62 thereby allowing manual rotation of the first adjustment member 66 to elevate or descend the first body 64 upon the first base 62. Alternatively, a hydraulic jack system could be utilized for the first lift assembly 60.

As shown in FIGS. 1, 2, 3 and 5 of the drawings, a second lift assembly 70 is attachable to the bracket 22*a* of the support base 20. The second lift assembly 70 includes a second base 72 having a flat plate for engaging a ground surface. The second lift assembly 70 further includes a second body 74 that is slidably positionable over the second base 72. A second attachment plate 78 is secured to the side of the second body 74 for allowing attachment to the bracket 22*a*. A second adjustment member 76 is rotatably attached within the interior of the second body 74 and is threadably engaged with the interior of the second base 72 thereby allowing manual rotation of the second adjustment member 76 to elevate or descend the second body 74 upon the second base 72. Alternatively, a hydraulic jack system could be utilized for the second lift assembly 70.

Figure 4:
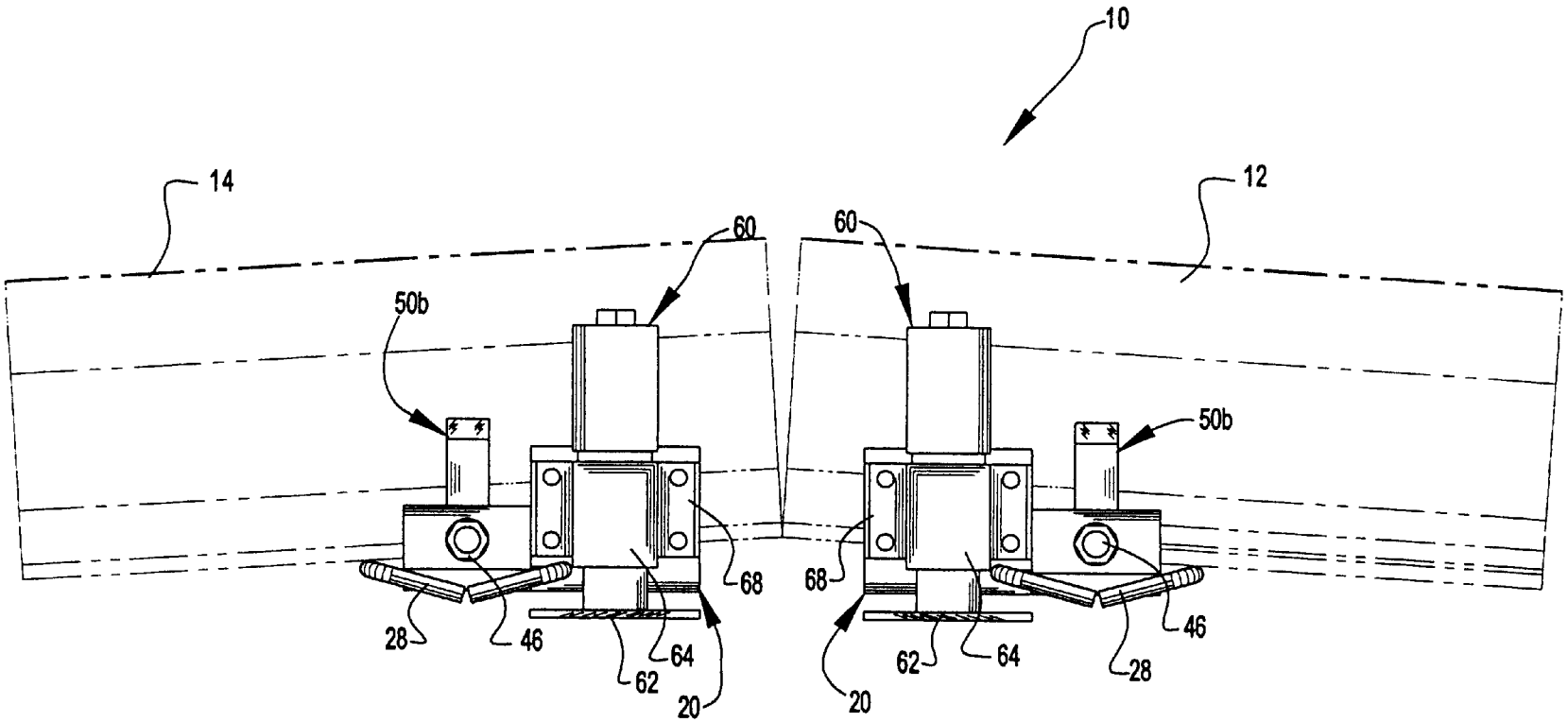
FIG. 4 is a side view of the present invention supporting the abutting rails.

In use, the user positions two units of the invention under a first rail 12 and a second rail 14 respectively that are to be welded together as shown in FIG. 4 of the drawings. The user then rotates the handles 50*a–b* so that the lip portion 52*a–b* snugly engages the lowered flanged edges of the rails 12, 14. The user then adjusts the first lift assembly 60 and the second lift assembly 70 of both units to the desired height so that the first rail 12 and the second rail 14 are both approximately 3.5 degrees with respect to the ground surface thereby forming an inverted V-shape. If one of the rails 12, 14 is twisted with respect to the other, the user adjusts the rotational position by differentiating the height of the first lift assembly 60 with respect with the second lift assembly 70. If the horizontal position of one of the rails 12, 14 is misaligned, the user can adjust the adjustment shaft 46 thereby moving the upper plate 40 along with the rail 12, 14 to the desired position. The user then utilizes conventions systems to weld the ends of the first rail 12 and the second rail 14 together. Immediately after welding the first rail 12 and the second rail 14 together, the user can utilize conventional shearing devices to shear the excess welding material from the rails 12, 14 while it is still soft thereby making a smooth surface of the train to ride upon. The user is also free to grind the rails 12, 14 while the weld is hardening. After a desired period of time allowing the weld to harden, the user lowers and removes both of the units from under the rails 12, 14 while they are temporarily supported by another structure such as wedges.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rail support system for supporting a rail in an adjustable vertical and rotational manner, comprising:

a support base having a first end and a second end, wherein said support base is capable of receiving the rail;

a first lift means attached to said first end for adjusting the vertical height of said first end; and a second lift means attached to said second end for adjusting the vertical height of said second end, wherein adjustment of the rail in a rotational manner is achieved by adjusting the first lift means and the second lift means with respect to one another.

2. The rail support system of claim 1, including a locking means for securing said rail to said support base.

3. The rail support system of claim 2, wherein said securing means allows a horizontal position of said rail to be adjusted.

4. The rail support system of claim 3, wherein said locking means comprises:

an upper plate slidably attached to said support base; and a pair of handles rotatably attached to said upper plate, wherein said pair of handles each have a lip portion for selectively engaging an upper surface of a flanged edge of said rail.

5. The rail support system of claim 4, wherein said locking means further includes an adjustment means for allowing manipulation of said horizontal position of said rail.

6. The rail support system of claim 5, wherein said adjusting means comprises:

an interiorly threaded member secured to said upper plate; and an adjustment shaft rotatably attached within said support base and threadably connected with said interiorly threaded member.

7. The rail support system of claim 6, including a handle attached to said support base.

8. The rail support system of claim 7, wherein said first lift means and said second lift means each comprise:

a base;

a body attachable to said support base, wherein said body is vertically slidably about said base; and an adjustment member rotatably attached within said body and threadably attached within said base for allowing vertical adjustment of said body with respect to said base thereby allowing elevating of said support base.

9. The rail support system of claim 8, wherein said locking means further includes:

a slot within said support base; and a slide plate having a pair of flanged portions extending from said slide plate, wherein said slide plate is slidably positioned within said slot.

10. The rail support system of claim 9, wherein said support base is comprised of a swaged plate extending between said first lift means and said second lift means.

11. A rail support system for supporting a rail in an adjustable vertical and rotational manner, comprising:

a support base having a first end and a second end, wherein said support base is capable of receiving the rail;

a first hydraulic lift attached to said first end for adjusting the vertical height of said first end; and a second hydraulic lift attached to said second end for adjusting the vertical height of said second end, wherein adjustment of the rail in a rotational manner is achieved by adjusting the first lift means and the second lift means with respect to one another.

12. The rail support system of claim 11, including a locking means for securing said rail to said support base.

13. The rail support system of claim 12, wherein said securing means allows a horizontal position of said rail to be adjusted.

14. The rail support system of claim 13, wherein said locking means comprises:

an upper plate slidably attached to said support base; and a pair of handles rotatably attached to said upper plate, wherein said pair of handles each have a lip portion for selectively engaging an upper surface of a flanged edge of said rail.

15. The rail support system of claim 14, wherein said locking means further includes an adjustment means for allowing manipulation of said horizontal position of said rail.

16. The rail support system of claim 15, wherein said adjusting means comprises:

an interiorly threaded member secured to said upper plate; and an adjustment shaft rotatably attached within said support base and threadably connected with said interiorly threaded member.

17. The rail support system of claim 16, including a handle attached to said support base.

18. The rail support system of claim 17, wherein said locking means further includes:

a slot within said support base; and a slide plate having a pair of flanged portions extending from said slide plate, wherein said slide plate is slidably positioned within said slot.

19. The rail support system of claim 18, wherein said base is comprised of a swaged plate extending between said first lift means and said second lift means.

* * * * *